US006863746B2

(12) United States Patent
Weinstein

(10) Patent No.: US 6,863,746 B2
(45) Date of Patent: Mar. 8, 2005

(54) WHITE GOLD COMPOSITIONS WITHOUT NICKEL AND PALLADIUM

(76) Inventor: Keith Weinstein, 4316 Marma City Dr., Marina del Rey, CA (US) 90292

( * ) Notice: Subject to any disclaimer, the term of this patent is extended or adjusted under 35 U.S.C. 154(b) by 15 days.

(21) Appl. No.: 09/921,357

(22) Filed: Aug. 2, 2001

(65) Prior Publication Data

US 2003/0075295 A1 Apr. 24, 2003

(51) Int. Cl.[7] ..... C22C 9/00

(52) U.S. Cl. ..... 148/433; 148/442; 420/511; 420/587; 420/589

(58) Field of Search ..... 148/430, 433, 148/434, 442; 420/473, 476, 477, 482, 493, 512, 507, 587, 589, 511, 508

(56) References Cited

U.S. PATENT DOCUMENTS

| | | | | | |
|---|---|---|---|---|---|
| 3,661,569 | A | * | 5/1972 | Abbott | 420/505 |
| 3,663,217 | A | * | 5/1972 | Olson et al. | 420/508 |
| 3,981,723 | A | * | 9/1976 | Tuccillo | 420/508 |
| 4,049,434 | A | * | 9/1977 | Sloboda et al. | 420/482 |
| 4,587,097 | A | * | 5/1986 | Rabinkin et al. | 420/473 |
| 5,340,529 | A | * | 8/1994 | DeWitt et al. | 420/483 |
| 6,342,182 | B1 | * | 1/2002 | Vincent | 420/508 |
| 6,413,651 | B1 | * | 7/2002 | Yan et al. | 428/592 |
| 6,576,187 | B2 | | 6/2003 | Ribault et al. | |

FOREIGN PATENT DOCUMENTS

| | | | | |
|---|---|---|---|---|
| DE | 3146794 | * | 6/1983 | |
| DE | 3211703 | * | 10/1983 | |
| DE | 3414128 | * | 12/1985 | |
| GB | 2091294 | * | 7/1982 | |
| JP | 54-101711 | * | 8/1979 | 420/512 |
| JP | 56-166352 | * | 12/1981 | 148/402 |
| JP | 1-123057 | * | 5/1989 | 420/511 |

OTHER PUBLICATIONS

Environmental Health Information Service, "Nickel and Certain Nickel Compounds," *Ninth Report on Carcinogens*, 11 pgs, U.S. Department of Health and Human Services (Jan., 2001).

* cited by examiner

*Primary Examiner*—John P. Sheehan
(74) *Attorney, Agent, or Firm*—DLA Piper Rudnick Gray Cary US LLP

(57) ABSTRACT

The present invention discloses a white gold composition consisting essentially of copper, silver, zinc, and manganese, and further consisting of small amounts of tin, cobalt, silicon/copper and boron/copper. More particularly, the white gold composition of the present invention discloses a white gold composition consisting essentially of about 36% to about 57% copper, about 10% silver, about 18.2% to about 24.2% zinc, about 14% to about 28.9% manganese, and the balance further consisting of about 1% tin, about 0.025% to about 0.03% cobalt, about 0.52% silicon/copper, and about 0.2% boron/copper. An objective of the present invention is to provide for methods and compositions of casting, fabricating and soldering white gold that does not incorporate nickel or palladium. The present invention also discloses no tarnish results when hydrogen is used as a catalyst to all compositions.

13 Claims, No Drawings

WHITE GOLD COMPOSITIONS WITHOUT NICKEL AND PALLADIUM

BACKGROUND OF THE INVENTION

1. Field of the Invention

The present invention relates generally to a white gold composition for casting, fabricating or soldering jewelry.

More particularly, the present invention relates to a white gold composition consisting essentially of copper, silver, zinc, and manganese.

The present invention also relates generally to a white gold composition and, more particularly, to a white gold composition consisting essentially of copper, silver, zinc, and manganese and further consisting of lesser amounts of tin, cobalt, silicon/copper and boron/copper.

2. General Background and State of the Art

Gold is a yellow metallic element, however, in its pure form it is too soft to be used for general jewelry purposes. In jewelry making, it is standard to mix pure gold with other metals to produce an alloy. Alloys are a mixture of two or more metals. For example, 18 karat gold is comprised of 75% pure gold (24 karat gold) and a mixture of other elements including copper, silver, nickel and/or palladium. Which alloyed metal is dependent on the type and color gold desired (i.e. 18K yellow gold versus 18K white gold). Typically, copper and silver are mixed with pure gold to produce yellow gold alloys, while nickel and palladium are mixed with pure gold to produce white gold alloys.

To date, there are two key elements used to make white gold alloys: nickel and palladium.

There are advantages and disadvantages of using either nickel or palladium.

One advantage that nickel offers is that by "bleaching" out the yellow gold it contributes well to the white color of the gold alloy. The higher the nickel content the whiter the castings. The majority of white gold jewelry is nickel-based. Another advantage of nickel is that it is economical, costing about $1.00 to about $3.00 per ounce.

However, there are at least two negative aspects of nickel white gold: Potential for allergic reactions (i.e. dermatitis) and high casting melting temperatures.

The first disadvantage of nickel-based jewelry products, and the reason it is currently banned in Europe, is due to the increase in the number of allergic reactions to nickel. In particular, once someone becomes sensitized and has an allergic reaction to the nickel, it is permanent condition. Furthermore, the reaction can be quite severe. For example, it has been reported that an estimated 5% of individuals in Europe have allergic reactions to nickel-based metal alloys; while reported cases in the United States are not as high. Hence, the current European solution is to ban nickel as an additive in all metal alloys. However, substituting palladium, another metal used to bleach yellow gold to white gold, continues to be an alternative.

Moreover, nickel is considered to be slightly carcinogenic. Pursuant to Section 301 (b) (4) of the Public Health Service Act, the U.S. Department of Health and Human Services published that nickel and certain nickel compounds are "reasonably anticipated to be human carcinogens based on sufficient evidence of carcinogenicity of nickel and nickel containing compounds in experimental animals . . . and in humans." (Ninth Report on Carcinogens, 2001, "Nickel and Certain Nickel Compounds," U.S. Department of Health and Human Services Public Health Service National Toxicology Program; http://ehis.niehs.nih.gov).

In the same report, ingestion, inhalation and dermal contact were noted as the primary routes of potential human exposure to nickel and nickel containing compounds. Also, certain occupations were listed as having significant occupational exposure to nickel, including jewelers.

The second disadvantage of nickel-based metal alloys is that nickel white golds from a casting perspective mandate higher melting temperatures (melting point of nickel is 1455° C., or 2651° F.). Casting jewelry at these very high temperatures can cause sulfur dioxide reactions, or gas porosity. Increase in gas porosity results in poor quality metal alloys. Also, high melting temperatures produce heavy oxide formations, which limit fluidity and reusability when attempting to re-melt.

Lastly in order to increase fluidity and reusability, nickel-based white golds typically use silicon as an additive. Silicon additives may cause a potential problem with silicide hardspots (silicide is an intermetallic compound that forms when the silicon is combined with certain other elements, i.e. nickel, and in the presence of oxygen and pressure). Also silicide hardspots form due to high temperatures as mentioned previously. Thus, various processes of metal casting including the amount of oxygen (air), the melting temperatures and the specific additives determine the size of the silicide hardspots. For example, the greater the oxygen exposure and the longer the cool time will create some considerably large silicide hardspots.

In addition, nickel-based white gold is subject to what is called Stress Corrosion Cracking. Stress corrosion cracking is a metallurgical issue caused by weak grain boundaries that occur in wrought products that are hard and under stress, and can be observed as broken or cracked prongs. The grain boundaries under stress are corroded easily by many chemicals including household variety chemicals.

Thus, the main disadvantages of nickel-based white gold alloys include allergic reactions to nickel; the carcinogenic properties of nickel; high melting and casting temperatures of nickel; and the silicon additive content of nickel-containing jewelry products, which causes silicide hardspots. In short, the disadvantages of using nickel to bleach pure yellow gold to make white gold alloys present some difficult problems.

Palladium-Based White Gold Casting:

The second option to producing white gold is bleaching yellow gold with palladium. Similar to the use of nickel in nickel-based white gold alloys, the higher the palladium the whiter the castings. Unlike nickel-based white gold, higher amounts of palladium produce a white gold that is more gray in color than white.

The disadvantages of using palladium-based white gold are: The high casting melting temperature; the extremely limited reusability of palladium; and the extremely high cost of palladium.

First, the palladium-based white golds mandate high melting temperatures during casting (1900° F.–2100° F.; or 1040° C.–1150° C.). Similar to high casting temperatures necessary for nickel-based white gold castings, high temperatures can cause sulfur dioxide reactions, or gas porosity. In addition, palladium-based alloys tend to solidify very quickly, therefore, perfect gating sprue techniques have to be incorporated in order to reduce gas porosity.

Secondly, palladium has limited reusability due to sulfur pickup by the palladium when using standard investment powders. These additives also increase the hardness of the alloy considerably and not in a positive way. Also, similar to nickel-based white gold alloys, silicon additives cause silicide hardspots.

Lastly, the high cost of palladium, currently up to about $500.00 U.S. dollars per ounce, as compared with approximately $275 U.S. dollars per ounce of gold itself, makes palladium a very expensive option to bleach pure yellow gold to make white gold. Also, the high cost of refining palladium make palladium alloys a very expensive alternative. Hence, when comparing the cost of palladium-based alloys to nickel alloys, palladium-based alloys are much more expensive.

Thus, although palladium is not known to cause any allergic reactions or considered carcinogenic, its high casting melting temperature, limited reusability and high cost do not make it an ideal choice for white gold casting.

SUMMARY

In summary, the above key issues involved with white gold casting alloys reveal that neither nickel nor palladium are good candidates for production and casting of white gold. For example, although nickel-based white gold alloys result in a very white and very hard piece of jewelry, at the same time, nickel can cause allergic reactions, is slightly carcinogenic and has high casting melting temperatures. More particularly, the increase in the number of allergic reactions to nickel-based products has caused the European nations to restrict its use, particularly, in jewelry and jewelry making processes. If nickel-based white gold alloys are prohibited in Europe, the other option is palladium-based white gold alloys. Yet, the extreme high cost of palladium makes it an uneconomical option.

Therefore, improved methods and compositions for making a non nickel- and a non palladium-based white gold alloy are advantageous.

Such improved methods and compositions for making white gold should contain metals that are not nickel and palladium, but that contribute to good color quality, malleability during casting, fabrication and soldering of jewelry.

Also, such improved methods and compositions, would further comprise specific teachings to combine more than one metal, other than nickel or palladium, to make a white gold alloy.

INVENTION SUMMARY

One aspect of the present invention is to provide a white gold alloy composition for casting, fabricating and soldering jewelry without the use of nickel and palladium elements.

In another aspect of the invention, a white gold alloy composition is provided for casting, fabricating and soldering jewelry consisting essentially of copper, silver, zinc and manganese.

In another aspect of the invention, a white gold alloy composition is provided for casting, fabricating and soldering jewelry consisting essentially of copper, silver, zinc and manganese, and further consisting of tin, cobalt, silicon/cobalt and boron/copper.

In another aspect of the invention, a white gold alloy composition is provided for casting, fabricating and soldering jewelry consisting essentially of about 36% to about 57% copper, about 10% silver, about 18% to about 24.2% zinc and about 14% to about 28.9% manganese.

In another aspect of the invention, a white gold alloy composition is provided for casting, fabricating and soldering jewelry consisting essentially of about 36% to about 57% copper, 10% silver, about 18% to about 24.2% zinc and about 14% to about 28.9% manganese, and the balance of the composition further consisting of about 0% to about 1% tin, about 0.025% to about 0.03% cobalt, about 0.52% silicon/copper and about 0.2% boron/copper.

In another aspect of the invention, a white gold alloy composition is provided for casting, fabricating and soldering jewelry consisting essentially of about 98% to about 99.26% copper, silver, zinc and manganese.

In another aspect of the invention, a white gold alloy composition is provided for casting, fabricating and soldering jewelry consisting essentially of about 98% to about 99.26% copper, silver, zinc and manganese, and the balance of the composition further consisting of about 0.74% to about 1.75% tin, cobalt, silicon/copper and boron/copper.

In another aspect of the invention, a 10K white gold alloy composition is provided for casting, fabricating and soldering jewelry consisting essentially of about 98% to about 99.26% copper, silver, zinc and manganese, and the balance of the composition further consisting of about 0.74% to about 1.75% tin, cobalt, silicon/copper and boron/copper and having casting temperatures in the range of about 1730° F. to about 1770° F.

In another aspect of the invention, a 14K white gold alloy composition is provided for casting, fabricating and soldering jewelry consisting essentially of about 98% to about 99.26% copper, silver, zinc and manganese, and the balance of the composition further consisting of about 0.74% to about 1.75% tin, cobalt, silicon/copper and boron/copper and having casting temperatures in the range of about 1745° C. to about 1760° C.

In another aspect of the invention, a 10K white gold alloy composition is provided for casting, fabricating and soldering jewelry consisting essentially of about 98% to about 99.26% copper, silver, zinc and manganese, and the balance of the composition further consisting of about 0.74% to about 1.75% tin, cobalt, silicon/copper and boron/copper and having casting temperatures in the range of about 1750° F. to about 1780° F.

DETAILED DESCRIPTION OF THE PREFERRED EMBODIMENTS

While the specification describes particular embodiments of the present invention, those of ordinary skill can devise variations of the present invention without departing from the inventive concept.

Alloying of Constituents

The first step is alloying silver with small amounts of high temperature additives such as silicon/copper, boron/copper and cobalt. These high temperature additives should be layered on top by alloying them separately with the fine silver (fine silver is defined as silver which is 99.999% to 100% pure silver).

The second step is loading the crucible. Load the crucible in the order of: zinc, copper and manganese, and the silver alloy formed above on top. Caution should be taken when handling manganese because it has a tendency to throw out sparks during various stages of the melting and casting process.

The next step is to sprinkle about ⅛th of a teaspoon of flux on the top. A recommended flux is a jewelry product consisting essentially of about 75% borax and about 25% boric acid powder by volume. However, it is within the scope of the present invention to use other flux compositions, which contain similar elements in weight percent by volume.

In the present invention, the cover gas is flaming hydrogen. It is emphasized that the composition of present invention performs best with the use of flaming hydrogen. However, other forms of hydrogen gas are alternatively used and discussed later in the description of this present invention. Hydrogen gas should cover the crucible, or the atmosphere above the water for shot, or the ingot mold for bars depending on the form of production.

Note, the alloy produced by the incorporation of the additives and the fine silver is made, dried and added into the overall melt as one first composition. The additives must be fully alloyed with the fine silver at approximately 150° F. (or about 66° C.) over the melting temperature of the silver (961.78° C.-melting point of silver). In the formulas with tin, the tin is layered with the zinc.

Furnace Melting

If melting the alloy in a gas/air mix blow type of furnace, place crucible into the furnace. The approximate time of melting is about 10 to 20 minutes total. Melt times are also dependent on the condition and type of the blow furnace used. Before continuing, make sure all constituents are thoroughly melted. This can be achieved by using a stir stick.

Once constituents are melted, the melt is now ready to pour into alloy. In one aspect of the present invention, it is recommended that a type of shotting or grain-making device, in conjunction with the furnace melt, is used.

Pour the new alloy material through the shotting crucible . The mixture is poured into water through the shotting crucible immediately after it incorporates, or all the metals are mixed. Note, there is only about 5 to 10 seconds to give it a quick and vigorous stir.

Flaming hydrogen should be used liberally on the tongs as well as over the water and over the crucible.

Induction Melting

If melting using an induction coil machine, load the crucible as described above in furnace melting. Melt the constituents, or alloy, on medium frequency until the constituents (or alloy) melts and pools up nicely in the crucible. The Jolian heating then mixes the constituents. After incorporation of the constituents (or alloy), no more than 5 to 8 seconds should pass by before pouring the constituents (or alloy).

Torch Melting

If melting using a torch, use a very soft, feathery flame with high hydrogen content but low oxygen content. While rolling the metal back and forth in the melting dish, use a circular motion with the torch. Continue this motion until all the constituents are completely melted. A quick vigorous stir before pouring the alloy may be necessary. After the last of the constituents pools up, then pour the alloy immediately. If shotting into water, use a feathery hydrogen flame to pour the metal through. Again, the best choice of gas to use with the oxygen is hydrogen.

TABLE I

TEMPERATURE RANGES FOR ALLOYING CONSTITUENTS (ALREADY ALLOYED)

| Gold Alloy | Pasty Range | Molten | Pouring |
|---|---|---|---|
| 14K alloy | 939 to 960° C. | 970° C. | 975° C. |
| 18K alloy | 949 to 975° C. | 980° C. | 985° C. |

Karating of the Alloy with Pure Gold (10K, 14K and 18K)

Furnace Melting

The specific percentage of pure gold is first added to the constituents in the crucible (i.e. 75% of pure gold to make 18-karat white gold, 58.33% pure gold to make 14-karat white gold, etc.,). The crucible is then placed into the furnace. After all the constituents have melted, stir the constituents vigorously and quickly. Then pour immediately. Again, after all the constituents are incorporated, it is important that no amount of time is wasted before pouring the melt. A dull metal with oxidation and gas porosity on the grain results if too much time has lapsed between the time the constituents become incorporated and the time of pouring. Hence, pouring the shot/grain immediately after incorporation results in a shiny and silvery colored metal alloy. Also, the metal will still cast fine even if the pouring grain is dull or has spots, however, the quicker is the better.

Torch Melting

Both the alloy (discussed above under "Alloying Constituents") and the gold are placed into a crucible, with the alloy on the bottom and the 24K pure gold layered and covering the top of the alloy. A soft, feathery flame (or reducing flame) is used to melt the entire melt. Tipping the crucible from side to side, will melt down the metal from the sides and the bottom of the crucible. Again, once the constituents have completely melted, perform a quick and vigorous stir. Then immediately pour the melt. Karating first, results in the best no-tarnish melt. A re-melting process is performed for the casting. This is in contrast to casting the same melt that is karated.

Induction Melting

Layer the alloy in the bottom of the crucible and layer the 24K pure gold on top. Melt the constituents at medium frequency until both alloy and 24K pure gold are incorporated. After incorporation of alloy and pure gold, pour immediately. Again, do not wait more than 5 to 8 seconds before mixing. Pouring the shot immediately results in a shinier and more uniform metal. If it is possible, use hydrogen as a cover.

TABLE II

TEMPERATURE RANGES OF KARATED ALLOY

| Gold Alloy | Pasty Range | Molten | Pouring |
|---|---|---|---|
| 10K alloy | 1630° F.–1725° F. (888° C.–941° C.) | 1725° F. (888° C.) | 1730° F.–1770° F. (888° C.–946° C.) |
| 14K alloy | 1650° F.–1730° F. (899° C.–943° C.) | 1735° F. (888° C.) | 1745° F.–1760° F. (888° C.–946° C.) |

Casting of the Karated Alloy

Various adjustments to the casting process is necessary and dependent on the metals' need to be cast or poured immediately after the melting point. For example, most karated alloys in jewelry are cast between about 125° F. to about 185° F. (or about 52° C. to about 85° C.) over and above the melting point of the particular alloy being used. However, all alloys require a heat-up stage beyond the melting point, and are then cast right after it melts.

Load the flask to be cast before beginning the steps of melting the metal because the metal melts quickly. Once the metal is molten and pools up, it must be cast into the flask immediately. Again, after the constituents have melted, do not wait more than 5 to 8 seconds to quickly and vigorously stir it. The temperature range of the flask is similar to temperature ranges for normal casting. Temperature is also dependent on the size and thickness of the jewelry pieces. Therefore, the flask range can be anywhere between about 900° F. to about 1050° F. (or about 482° C. to about 586° C). Temperature ranges can be about 100° F. to about 1150° F. (or about 38° C. to about 621° C.) may be used for filigree.

Also, do not overspue the waxes prior to investing and casting. There is a tendency to get cracking if too large a sprue is used. For example, most rings require between a 10 gauge wax wire for women's styles and smaller pieces, and no less than 8 gauge for men's styles and heavier pieces. Using more or less than this range is dependent on the size of the pieces.

Blow Furnace

Melt [karated alloy] in the furnace until just molten. Again, waste no more than 5 to 8 seconds before stirring the constituents quickly and vigorously. Then pour the constituents into the flask immediately. When bringing the crucible out of the furnace to bring to wherever the flask and casting device are, cover gas can be used on the crucible tongs; however, cover gas is not essential. Again, the best smooth castings, which are free of gaseous pits, are done when the speed of pouring the metal after it melts are accomplished as quickly as possible. Waiting more than the allotted amount of time will result in castings that are severely surface pitted and not usable. Additionally, waiting too long to pour the melt also results in severe cracking. Severe cracking further leads to metal oxidation and causing potential problems with the quality of the white color in later finishing processes.

Induction Casting Machine

After the flask has been loaded into the vacuum chamber, melt the karated alloy at reduced normal frequencies. The metal the karated alloy melts quickly, so as soon as the metal is completely melted, allow between 5 and 8 seconds (to allow metal to be mixed by the Jolian heat action) then immediately push the cast button. If the metal is overheated, the result is severe surface pitting and possibly cracks in the castings. Lower the casting temperature of the metal gradually until the castings are smooth and pit free. However, while performing the adjustment, leave the flask/oven temperature the same.

Torch Casting

As with all the torch applications with these metals, a soft and feathery flame of hydrogen and oxygen gives the best results. Also, increasing the amount of hydrogen gas, while decreasing the amount of oxygen, is recommended. Using a circular motion with the torch while simultaneously tilting the melting dish back and forth until all the metal melts and pools. Then, similar to the above procedures, cast into the flask immediately. It is easier to "dump" the metal into the flask quickly instead of using a slow and smooth pour because the metal appears less fluid than most metals. Caution must be used not to go past the casting point of the metal, otherwise severe porosity and cracking all over the surface of the piece may result. If there is gas porosity and cracking, gradually reduce the temperature until the smoothness of the surfaces appears and the cracking ceases.

Note, as with all the melts described above, a small sprinkling of flux halfway through the melt is extremely helpful. The flux not only cleans and deoxidizes the metal during the melt, but the flux also lowers the melting temperature slightly and assists in a quicker and cleaner process. Do not be alarmed if sparks are produced coming off the melt when flux is added.

After Cast Treatment

Wait for 10 to 15 minutes before dowsing the flask into water. Blow off the remaining investment with a high-pressure sprayer. Once this has been done, there remains very little of the investment left. The cast tree of these metal resists clinging investment and it becomes very clean immediately.

Prepare a simple heated pickle consisting of 90% water and 10% nitric acid. Put the cast tree into the pickle for greater than about 30 seconds and up to about 5 minutes. The golden bronze color of the raw casting will fall off and reveal a white colored casting with a pale yellow tint. The surfaces should be very smooth, with no breaks or cracking.

Finishing

This metal can be lapped, cratexed or sanded with any device available. The very white color comes out right away as the piece of jewelry is being sanded down. Tripoli is a good cutting compound for buffing or polishing. However, it is within the scope of the present invention to use any appropriate cutting compound (i.e. Red Rouge and Green Rouge). The Red Rouge leaves the piece of jewelry a little lighter, and the Green gives a darker, earthier color and hue. Also, a product called Blue Magic cream can be used with great results.

Ideally if all the factors in the various processes (i.e. melting, karating, casting, etc.,) are properly carried out, there is little porosity in the jewelry pieces. Various porosities and pits will disappear during the finishing processes of sanding. If there is more than the normal amount of pitting in the cast, the metal was too hot. To remedy this, gradually lower the cast metal temperature until the pitting disappears. Unlike most cast golds where the pits are very deep, the above processes result in very small pits if any at all. Next to last, use a hot ultrasonic solution to clean the polishing compounds off. Lastly, steam dry the piece of jewelry.

Wire and Sheet:

Annealing should follow that of a yellow gold, rather than that of a white nickel gold. That means quenching immediately instead of air-cooling the bar. Sheets can be rolled, and wires drawn using the alloy without the silicon-copper, cobalt, or boron additives.

Modifications of the Invention Regarding the Use of Hydrogen.

The use of hydrogen gas in all of the processes listed in the present invention is very important if one is to attain a white gold jewelry that resists tarnishing and color changes. Moreover, different modifications are used depending on the type of gas available. For example, when using a melting gas, hydrogen plus a gas-rich mixture in combination with reduced oxygen is recommended. Empirically, this means a reducing flame is used in all processes of casting, fabricating and soldering. In another example, when using a cover gas for pouring shot (both alloying and karating), a flaming hydrogen is preferable. In fact, if the hydrogen is not used, there is no guarantee that the white gold composition will not tarnish.

Additionally, when using frequency-type casting machines, such as enclosed atmosphere machines, using hydrogen within the melting chamber and below it, in the case of shotting grain, is within the scope of this invention. For example, a hydrogen pressure with a nice soft flame, covering only the crucible is recommended.

Also, it is within the scope of the present invention to use propane or natural gas for processes described herein, however, the use of hydrogen enhances the best effects of white gold alloys, and prevents tarnishing. Again, if the hydrogen is not used, there is no guarantee that the white gold compositions will not tarnish.

Procurement of Materials

All of the metals in the following formulas(Examples 1–2) and that described above are of the following purities: Copper (Cu) 99.95%; Zinc (Zn) 99.99%; Silver (Ag) at least 99.95%; Manganese (Mn) 99.9%; Tin (Sn) 99.8%; Boron (Bo) 2% in Copper (Copper is 99.95%); Silicon (Si) 10% in Copper (Copper is 99.95%); and Cobalt (Co) 99.95%.

The invention is illustrated by the following examples. These Examples are presented for illustration only and are not intended to limit the invention. The examples are presented in terms of percentages by weight of any one component in a composition.

EXAMPLE 1

General White Gold Casting Formulas

In the present invention, a composition for casting, fabricating or soldering white gold jewelry consists essentially of about 98% to about 99% by weight copper, silver, zinc and manganese.

Also in the present invention, a composition for casting, fabricating or soldering white gold jewelry consists essentially of about 98% to about 99% by weight copper, silver, zinc and manganese, and further consists of about 1% to about 2% by weight tin, cobalt, silicon/copper and boron/copper.

EXAMPLE 2

White Gold Casting Formulas

| Gold Alloy | Cu | Ag | Zn | Mn | Tin | Cobalt | Si/Cu | Bo/Cu | Total |
|---|---|---|---|---|---|---|---|---|---|
| 10K | 57% | 10% | 18.2% | 14% | | 0.03% | 0.52% | 0.20% | 100% |
| 10K | 56.06% | 10% | 18.2% | 14% | 1% | 0.03% | 0.52% | 0.20% | 100% |
| 14K | 51.16% | 10% | 20.2% | 17.9% | | 0.025% | 0.52% | 0.20% | 100% |
| 14K | 52.55% | 10% | 18.2% | 17.5% | 1% | 0.025% | 0.52% | 0.20% | 100% |
| 18K | 36.16% | 10% | 24.2% | 28.9% | | 0.025% | 0.52% | 0.20% | 100% |
| 18K | 36.26% | 10% | 24.2% | 27.8% | 1% | 0.025% | 0.52% | 0.20% | 100% |

EXAMPLE 3

Solders

| Gold Alloy | Indium (In) | Ga/Cu/InTotal |
|---|---|---|
| 10KWE Solder | *3–5% | |
| 10KWH Solder | | *3–5% |
| 14KWE Solder | *3–5% | |
| 14KWH Solder | | *3–5% |
| 18KWE Solder | 3–5% | |
| 18KWH Solder | *3–5% | *Can Vary |

*All of the solders bead-up slowly, then flow nicely.
*Do not use Cobalt, Silcon/Copper, and Silicon/Boron if solders are made out of the original alloy material.

What is claimed is:

1. A white gold composition for casting, fabricating or soldering jewelry comprising 24K gold, and an alloy composition consisting essentially of copper, silver, zinc, manganese, tin, cobalt, silicon/copper and boron/copper.

2. A white gold composition as in claim 1 wherein, the alloy composition is comprised of about 98% to about 99% by weight copper, silver, zinc and manganese combined.

3. A white gold composition as in claim 2 comprised of about 1% to about 2% by weight tin, cobalt, silicon/copper and boron/copper combined.

4. A white gold composition as in claim 1, wherein the alloy composition is about 36% to about 57% by weight copper, about 10% by weight silver, about 18% to about 25% by weight zinc and about 14% to about 29% by weight manganese.

5. A white gold composition as in claim 4, wherein the alloy composition is about 2% by weight of tin, cobalt, silicon/copper, and boron/copper combined.

6. A white gold composition as in claim 5, wherein the alloy composition is about 0% to about 1% by weight of tin, about 0% to about 0.05% by weight cobalt, about 0.4% to about 0.6% by weight silicon/copper, and about 0.2% by weight boron/copper.

7. A 10K white gold composition comprising of about 41.67% by weight 24K gold and about 58.33% by weight an alloy composition comprised of about 57% by weight copper, about 10% by weight silver, about 18.2% by weight zinc, about 14% by weight manganese, about 0.75% to about 1% by weight tin, cobalt, silicon/copper, and boron/copper combined.

8. A 10K white gold composition comprising of about 41.67% by weight 24K gold and about 58.33% by weight an alloy composition comprised of about 56% by weight copper, about 10% by weight silver, about 18.2% by weight zinc, about 14% by weight manganese, about 0.75% to about 1% by weight tin, cobalt, silicon/copper, and boron/copper combined.

9. A 10K white gold composition comprising of about 41.67% by weight 24K gold and about 58.33% by weight an alloy composition comprised of about 56.06% by weight copper, about 10% by weight silver, about 18.2% by weight zinc, about 14% by weight manganese, and the balance consisting of about 0.75% to about 1% by weight tin, cobalt, silicon/copper, and boron/copper combined.

10. A 14K white gold composition comprising of about 58.33% by weight 24K gold and about 41.67% by weight an alloy composition comprised of about 51.15% by weight copper, about 10% by weight silver, about 20.2% by weight zinc, about 17.9% by weight manganese, and the balance consisting of about 0.75% to about 1% by weight tin, cobalt, silicon/copper, and boron/copper combined.

11. A 14K white gold composition comprising of about 58.33% by weight 24K gold and about 41.67% by weight an alloy composition comprised of about 52.55% by weight copper, about 10% by weight silver, about 18.2% by weight zinc, about 17.5% by weight manganese, and the balance consisting of about 0.75% to about 1% by weight tin, cobalt, silicon/copper, and boron/copper combined.

12. A 18K white gold composition comprising of about 75% by weight 24K gold and about 25% by weight an alloy composition comprised of about 36.16% by weight copper, about 10% by weight silver, about 24.2% by weight zinc, about 28.9% by weight manganese, and the balance consisting of about 0.75% to about 1% by weight tin, cobalt, silicon/copper, and boron/copper combined.

13. A 18K white gold composition comprising of about 75% by weight 24K gold and about 25% by weight an alloy composition comprised of about 36.25% by weight copper, about 10% by weight silver, about 24.2% by weight zinc, about 27.8% by weight manganese, and the balance consisting of about 0.75% to about 1% by weight tin, cobalt, silicon/copper, and boron/copper combined.

* * * * *